United States Patent [19]

Kobayashi

[11] 4,029,070

[45] June 14, 1977

[54] FUEL SUPPLY SYSTEM FOR INTERNAL COMBUSTION ENGINE

[75] Inventor: Akira Kobayashi, Nagoya, Japan

[73] Assignee: Kabushiki Kaisha Toyota Chuo Kenkyusho, Nagoya, Japan

[22] Filed: Aug. 6, 1975

[21] Appl. No.: 602,314

[30] Foreign Application Priority Data

Aug. 7, 1974 Japan ..... 49-90606

[52] U.S. Cl. ..... 123/139 AN; 123/139 R

[51] Int. Cl.[2] ..... F02M 39/00

[58] Field of Search ..... 123/139 AW, 139 AN, 123/139 BG

[56] References Cited

UNITED STATES PATENTS

| | | | |
|---|---|---|---|
| 2,502,679 | 4/1950 | Stanly | 123/139 BG |
| 2,869,528 | 1/1959 | Tuschel | 123/139 AN |
| 3,739,762 | 6/1973 | Jackson | 123/139 AW |
| 3,826,234 | 7/1974 | Cinguegrani | 123/139 AW |

*Primary Examiner*—William R. Cline
*Attorney, Agent, or Firm*—Cushman, Darby & Cushman

[57] ABSTRACT

A fuel supply system for use with an internal combustion engine of the type in which the air intake quantity is substantially in proportion to the engine speed and the opening degree of a throttle valve and the fuel to be mixed with the air is injected through a fuel injection nozzle, said fuel supply system comprising pump means which discharges the fuel in proportion to the engine speed, and a fuel shunt device for supplying a part of the fuel supplied from said pump means to said fuel injection nozzle while recirculating the remaining fuel to said pump means, said fuel shunt device having first valve means for automatically controlling the area of the opening of a passage hydraulically connecting said fuel shunt device to said fuel injection nozzle in proportion of the discharge rate of said pump means, and second valve means for automatically controlling the area of the opening of a return line hydraulically connecting said fuel shunt device to said pump means in inverse proportion to the opening degree of said throttle valve, whereby the air-fuel mixture with a substantially constant air-fuel ratio independently of the speed and load of the engine may be charged into the engine.

5 Claims, 9 Drawing Figures

AIR-FUEL RATIO
PRESSURE DIFFERENCE kg/cm²
FUEL-SUPPLY cm³/s
ENGINE SPEED R.P.M.
A (RATIO 14.7:1)
B (RATIO 19:1)
B'
19:1
14.7:1
ΔPf
ΔPf'
ΔPf+ΔPf'
0
1000
2000
3000
4000
5000
5
10
15
20
1
2
3
4
5
6
7
8

FLOW VELOCITY Wr m/s
50
40
30
20
FUEL RECIRCULATED cm³/s
3
2
1
0
1.0
0.5
AREA OF OPENING OF RETURN LINE mm²
B''
Wr
S
3300rpm
1000
2000
3000
4000
5000
ENGINE SPEED R.P.M.

FUEL SUPPLY SYSTEM FOR INTERNAL COMBUSTION ENGINE

BACKGROUND OF THE INVENTION

The present invention relates to a fuel supply system for an internal combustion engine which may supply always the fuel in such a ratio that the pollutant content in the engine exhaust may be minimized under any operating conditions of said engine.

The content of the pollutants in the engine exhaust is dependent upon the air-fuel ratio of the air-fuel mixture to be burnt, and the emission of pollutants may be minimized when the air-fuel ratio is maintained within a certain range slightly leaner than the stoichiometric air-fuel ratio. The conventional engines with a carburetor are in general so designed that the air-fuel mixture with an air-fuel ratio slightly leaner than the stoichiometric ratio may be charged into the engine under the medium load under which the engine is most frequently driven. Therefore the emission of pollutants under the medium load may be minimized, but the suction of gasoline increases under the light and heavy load in excess of the intake air quantity because of the inherent construction of the conventional carburetors, thus resulting in the excessively rich air-fuel mixture. As a result the pollutant content in the engine exhaust is increased. In case of the automotive internal combustion engines, they are generally driven under the medium load about 80% of the traveling milage, but the frequency of driving under the light or heavy load is extremely increased in the urban area. Therefore one of the air pollution problems in the automotive industry is to reduce the automotive pollutants even under the light or high load condition.

SUMMARY OF THE INVENTION

In view of the above, the primary object of the present invention is to provide a novel fuel supply system for an internal combustion engine which may automatically control the quantity of fuel to be injected to provide the air-fuel mixture with a substantially constant air-fuel ratio so that the pollutant emission may be minimized under any operating conditions.

To attain the above object, briefly stated the present invention provides a fuel supply system for an internal combustion engine of the type in which the air intake quantity is substantially in proportion to the engine speed and the opening degree of a throttle valve and the fuel to be mixed with the air is injected through a fuel injection nozzle, said fuel supply system comprising fuel pump means which discharges the fuel in proportion to the engine speed, and a fuel shunt device for supplying a part of the fuel supplied from said fuel pump means to the fuel injection nozzle while recirculating the remaining fuel to the fuel pump means, said fuel shunt means comprising first valve means for automatically controlling the area of the opening of a passage hydraulically connecting the fuel shunt device to the fuel injection nozzle in proportion to the discharge rate of the fuel pump means, and second valve means for automatically controlling the area of the opening of a return line hydraulically connecting the fuel shunt device to the fuel pump means in inverse proportion to the opening degree of the throttle valve, whereby the air-fuel mixture with a substantially constant air-fuel ratio independently of the speed and load of the engine may be charged into the engine.

DESCRIPTION OF THE PREFERRED EMBODIMENT

Prior to the description of the fuel supply system in accordance with the present invention, the relation between the pollutant content in the engine exhaust and the air-fuel ratio and the operating conditions of the engine will be described for the better understanding of the present invention.

Figure 1:
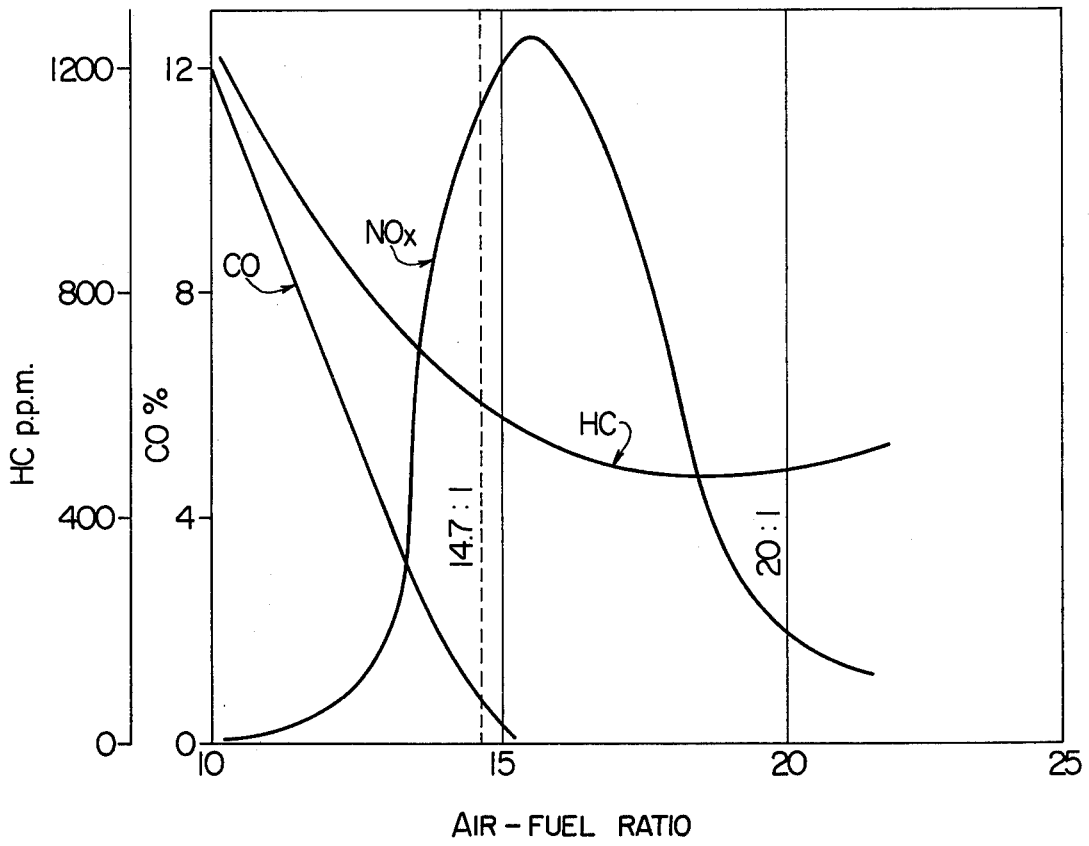
FIG. 1 is a graph showing the relation between the contents of pollutants contained in the engine exhaust and the air-fuel ratio.

FIG. 1 shows the relation between the contents of the pollutants such as CO, HC and NOx in the engine exhaust and the fuel-air ratio. As seen from FIG. 1, when the air-fuel mixture is rich; that is, when the air-fuel ratio is higher than the stoichiometric air-fuel ratio 14.7, the emission of the unburnt pollutants such as CO and HC is increased because of the want of oxygen. On the other hand, when the air-fuel mixture is extremely lean, the combustion speed is so low that the combustion mixture is discharged before it has been completely burnt or misfiring occurs. As a result, the unburnt pollutants are discharged. The emission of NOx, which is the cause of the photochemical smog, is increased as the combustion temperature is increased. That is, the emission of NOx reaches the maximum when the air-fuel ratio is slightly lower than the stoichiometric ratio, but the emission of NOx, CO and HC is minimized at the air-fuel ratio range between 18 and 20. Therefore, the internal combustion engines must be operated with the above air-fuel ratio range from the standpoint of the anti-air pollution.

Figure 2:
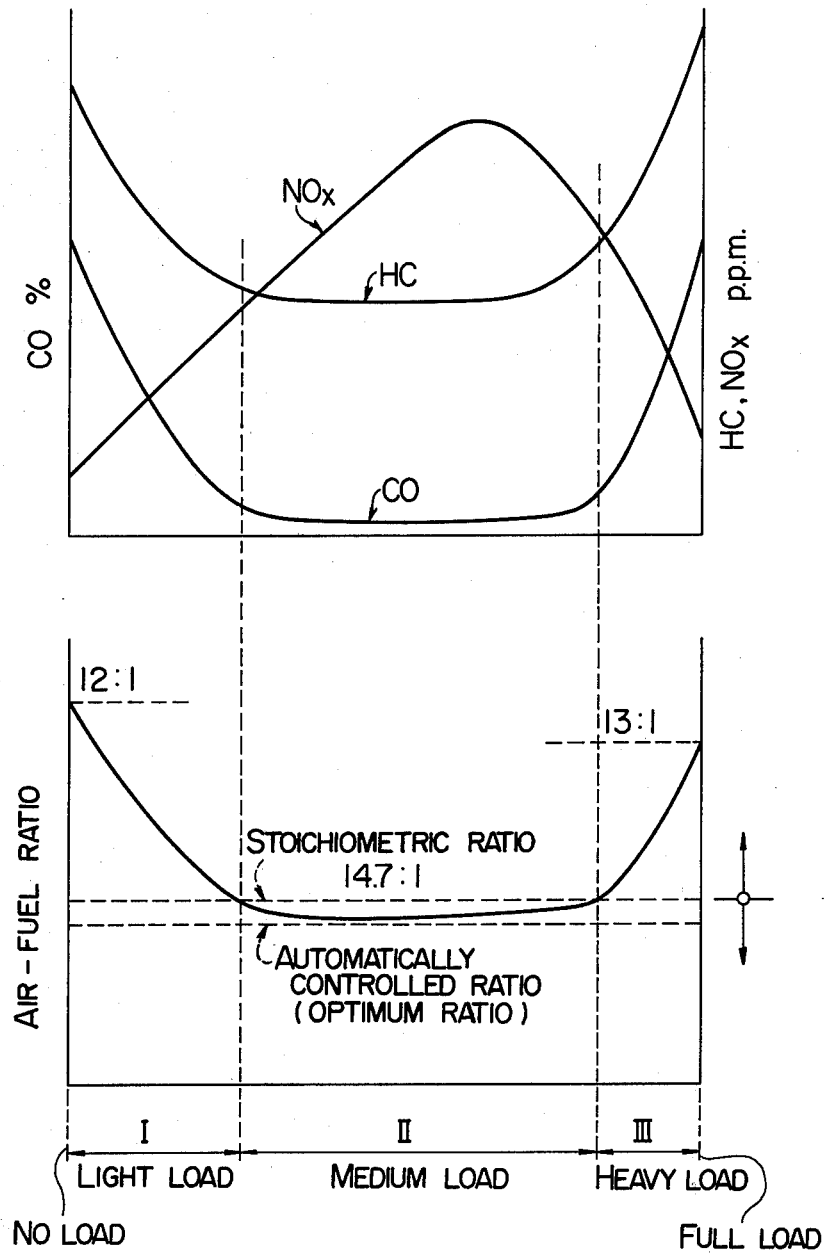
FIG. 2 is a graph showning the relations between the engine load and the contents of pollutants in the engine exhaust and between air-fuel ratio and the contents of pollutants in the engine exhaust in the conventional internal combustion engine with a carburetor.

FIG. 2 shows the relations between the engine load and the pollutant contents in the engine exhaust and between the air-fuel ratio and the pollutant contents in the engine exhaust, the data being obtained by driving a conventional internal combustion engine with a carburetor under various operating conditions. The engine was so adjusted that the air-fuel ratio may become slightly lower than the stoichiometric ratio under the medium load condition II. Under the medium load, the gasoline is sucked in proportion to the intake air quantity so that a constant air-fuel ratio slightly lower than the stoichiometric ratio may be obtained. However, under the light load condition I when the opening degree of the throttle valve is small, the suction of gasoline is increased, resulting in the excessively rich air-fuel mixture. Under the heavy load condition III, the pressure drop in the venturi is increased as the flow rate of the intake air is increased, so that the suction of gasoline is also increased, resulting in the excessively rich mixture. Therefore, as shown in the upper part of the graph shown in FIG. 2, the emission of CO and HC pollutants is increased under the light and heavy load conditions I and III. In the usual driving, the engine generally operates under the medium load condition II almost about 80% of the traveling milage, but in the urban areas the frequency of the light and heavy load operations is extremely increased so that the effective control of the automotive pollutant emission must be provided. In view of the above, the present invention has for its primary object to provide a novel fuel supply system for an internal combustion engine which may replace the conventional carburetors and which may supply the air-fuel mixture of the same air-fuel ratio even under the light and heavy load operations with that under the medium load operation, whereby the emission of the pollutants may be minimized under all load conditions.

Figure 3:
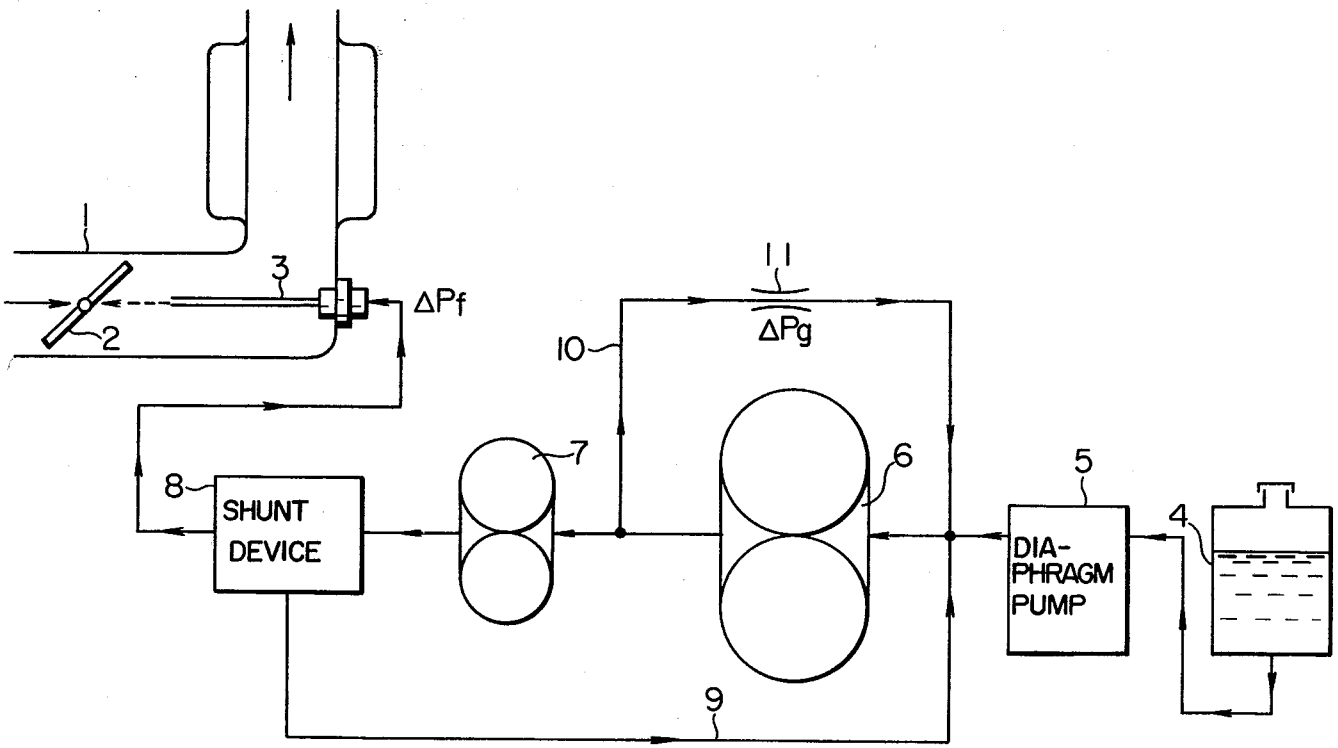
FIG. 3 is a diagrammatic view of one preferred embodiment of a fuel supply system in accordance with the present invention.

Next referring to FIG. 3, the fuel supply system in accordance with the present invention comprises a fuel injection nozzle 3 disposed at the downstream of a throttle valve 2 within an air intake pipe 1, a fuel tank 4, a diaphragm fuel pump 5, a governor pump 6, a fuel injection pump 7, and a fuel shunt device 8. The governor pump 6 and the fuel injection pump 7, both of which are of the gear type, are drivingly coupled to a cam shaft (not shown) of an engine so that they are driven at a speed in proportion to the speed of the engine. Therefore the flow rate of fuel flowing into the shunt device 8 is in proportion to the speed of the engine. The fuel shunt device 8 functions as means for controlling the flow rate of fuel, as will be described in detail hereinafter, in such a way that one portion of the fuel supplied from the fuel injection pump 7 is supplied to the fuel injection nozzle 3 while the remaining portion being returned through a return line 9 to the suction port of the governor pump 6. The governor pump 6 is provided in order that the discharge rate of the fuel injection pump 7 may gbe exactly in proportion to the speed of the engine. For instance, the governor pump 6 has the gears whose diameter is same with that of the gears of the fuel injection pump 7 and whose length (in the axial direction) is twice as long as that of the pump 7 so that the discharge rate of the governor pump 6 is twice as much as that of the fuel injection pump 7. One half of fuel discharged from the governor pump 6 is returned through a recirculation line 10 to the suction port thereof, and within the recirculation line 10 is placed a governor nozzle 11 the diameter of the nozzle hole of which is same with that of the fuel injection nozzle 3. Therefore, during the operation the injection pressure $\Delta P_f$ at the inlet to the fuel injection nozzle 3 may be made substantially equal to the governor pressure $\Delta P_g$ at the inlet to the governor nozzle 11. That is, the pressures at the suction and discharge ports of the injection pump 7, which are substantially equal to the governor pressure $\Delta P_g$ and the injection pressure $\Delta P_f$, are substantially made equal to each other. As a result, the leakage from the discharge side to the suction side within the pump 7 due to the pressure difference may be eliminated so that the discharge rate of fuel from the fuel injection pump 7 may be maintained exactly in proportion to the speed of the engine. The above is one of the most important underlying principles of the fuel supply system according to the present invention.

When the engine is started, the quantity of fuel supplied to the fuel injection nozzle 3 is desired to be preferably greater than that supplied from the fuel injection pump 7. For this purpose, a bypass line (not shown) may be provided interconnecting between the fuel injection nozzle 3 and the recirculation line 10 so that a part of or the whole of the fuel to be recirculated to the suction port of the governor pump 6 may be supplied to the fuel injection nozzle 3. The bypass line is normally closed by a cock or valve (not shown) except when the engine is started.

Figure 4B:
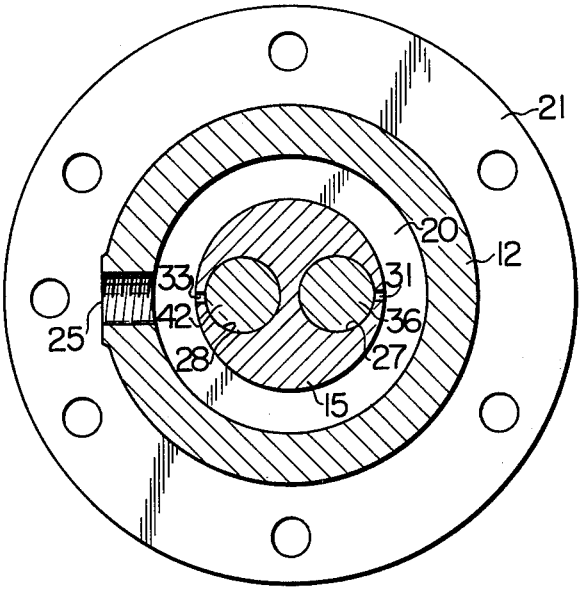
FIG. 4*b* is a sectional view thereof taken along the line *b—b* of FIG. 4*a;*

Next referring to FIG. 4 the construction of the fuel shunt device will be described in detail hereinafter. The fuel shunt device 8 has a cylindrical casing 12 whose bottom is closed with a bottom plate 14 with screws 13. A cylinder block 15 is inserted into the casing 12 coaxially thereof, and has it lower end screwed with the internally threaded screws 17 cut along the side surface of a recess 16 formed in the bottom plate 14 until the undersurface of a radially outwardly extending flange 18 of the cylinder block 15 may be firmly pressed against the upper surface of a radially inwardly extending flange 19 of the casing 12. Therefore, a closed annular chamber 20 is defined between the casing 12 and the cylinder block 15, and serves as an inlet or intake chamber for the fuel shunt device 8.

The radially outwardly extending flange of the casing 12 is attached to a top plate 23 with screws 22 so that an outlet or discharge chamber 24 may be defined by the top plate 23, the casing 12 and the cylinder block 15. The intake chamber 20 is communicated with the discharge port of the injection pump 7 through an intake port 25 formed through the side wall of the casing 12 while the outlet chamber 24 is communicated with the suction port of the governor pump 6 through a discharge port 26 formed through the flange 21 of the casing 12 and the return line 9 (see FIG. 3).

Two parallel cylinder bores 27 and 28 formed through the cylinder block 15 are intercommunicated with each other through a communication port 29 at the lower ends thereof, and are communicated with the fuel injection nozzle 3 through a supply port 30 formed at the center of the bottom plate 14.

The lower portion of the first cylinder bore 27 is communicated with the intake chamber 20 through a plurality of metering holes 31 which have the same diameter and which are arranged in line in the axial direction and vertically spaced apart from each other in a predetermined relation. The upper portion of the cylinder bore 27 is communicated with the intake chamber 20 through a second compensating hole 32. In like manner, the lower portion of the second cylinder bore 28 is communicated with the intake chamber 20 through a plurality (four in the instant embodiment) of over-driving holes 33 which have the same diameter and are spaced apart from each other vertically and equidistantly. The upper portion of the cylinder bore 28 is communicated with the intake chamber 20 through a plurality (11 in the instant embodiment) of small holes 34 and 35 which have the same diameter which are arranged in line in the axial direction and are vertically and equidistantly spaced apart from each other. The uppermost hole 35 is referred to as a "first compensating hole" while the remaining holes 34, as "return holes" in this specification.

A control piston 36 which is inserted into the first cylinder bore 27, is normally biased downward under the force of a spring 37, and its lowermost position is limited by a stopper 38 formed integral with the control piston 36 and extended downwardly from the bottom thereof. Therefore a control chamber 27' is defined below the control piston 36 in the first cylinder bore 27. The lowermost position of the control piston 36 is so selected that the control chamber 27' may be communicated with the inlet chamber 20 only through the lowermost metering hole 31. A spring retainer 39 screwed through the top plate 23 supports the upper end of the spring 37 and serves as a spring adjusting screw in such a way that when the control piston 36 is in the lowermost position, the pressure exerted from the spring 37 to the control piston 36 may be zero. The control piston 36 has an annular groove 40 formed around the side surface thereof slightly above the middle portion and communicated with the top end of the control piston 36 through a communication passage 41 formed through the piston 36. The function of the annular groove 40 in conjunction with the second compensating hole 32 will be described in detail hereinafter.

Figure 4A:
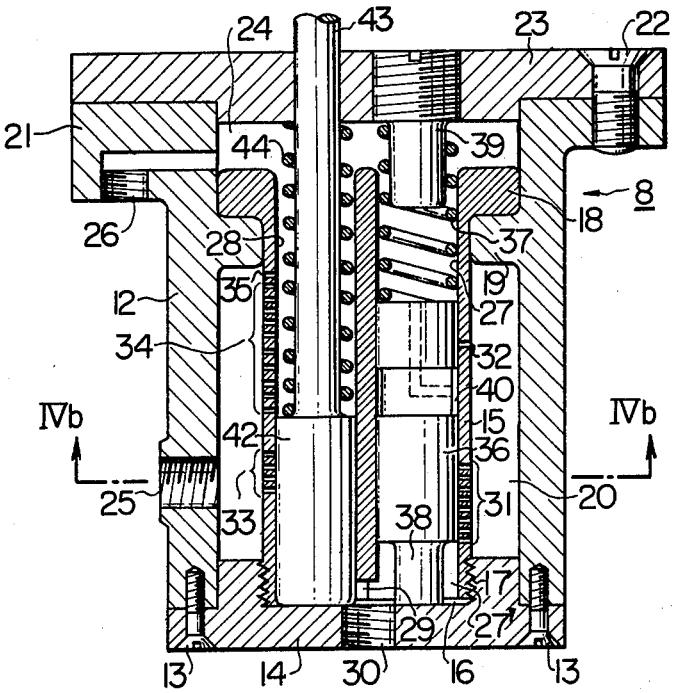
FIG. 4*a* is a longitudinal sectional view of a fuel shunt device shown by 8 in FIG. 3.

An acceleration piston 42 inserted into the second cylinder bore 28 has a piston rod 43 extended upwardly through the top plate 23, and is normally biased downward under the force of a spring 44 loaded between the top end of the acceleration piston 42 and the top plate 23. When the acceleration piston 42 is in the lowermost position at which the lower end of the piston 42 is made into contact with the bottom plate 14 as shown in FIG. 4*a*, all of the over-driving holes 33 are closed but the first compensating hole 35 and the return holes 34 are all opened. On the other hand, when the acceleration piston 42 is raised in such a position where the piston 42 closes all of the return holes 34 and the first compensating hole 35, all of the over-driving holes 33 are opened.

Figure 5:
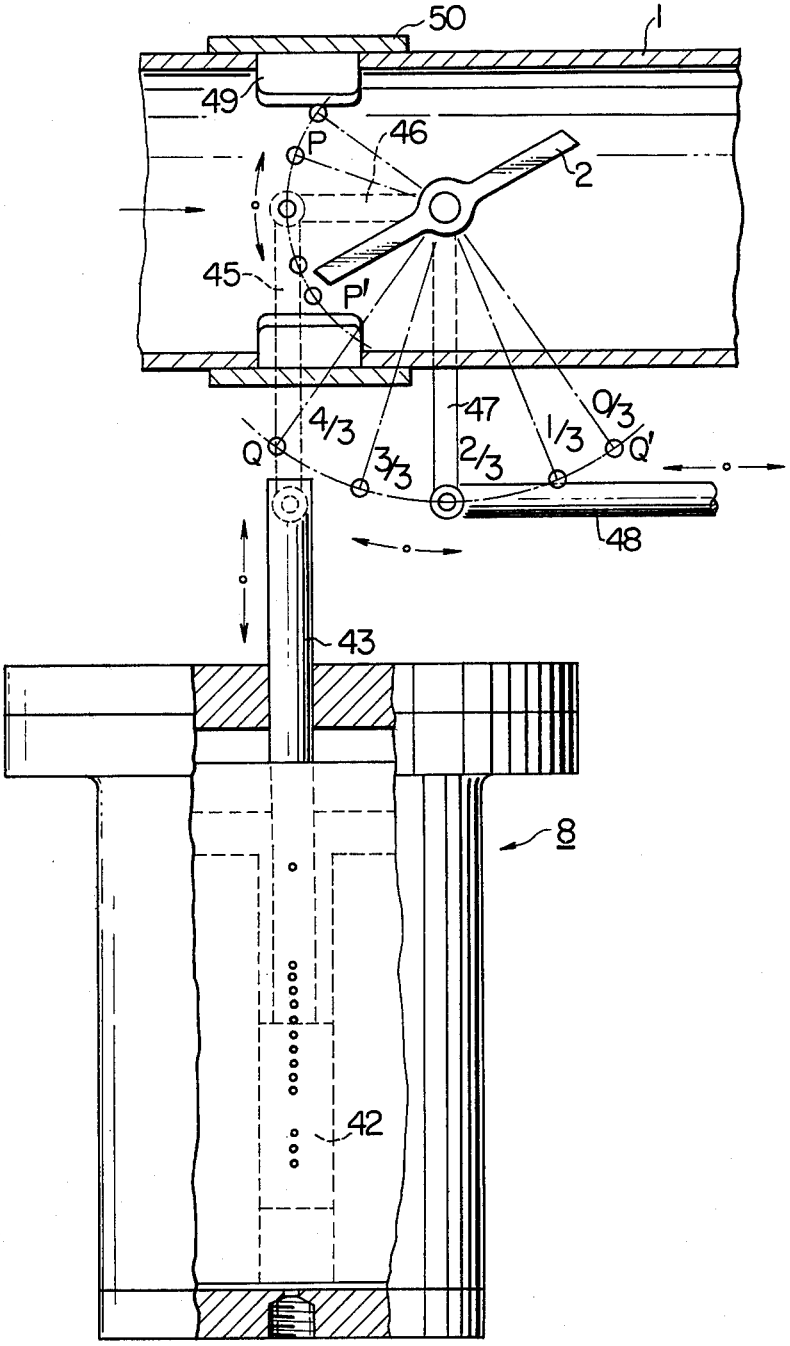
FIG. 5 is a schematic view showing the interconnection between the fuel shunt device and a throttle valve.

Next referring to FIG. 5, the upper end of the piston rod 43 of the acceleration piston 42 is pivoted to the lower end of a connecting rod 45 the upper end of which is pivoted to the free end of a first arm 46 attached to the shaft of the throttle valve 2 for rotation in unison therewith. The throttle valve 2 is operatively coupled to an acceleration pedal (not shown) through a second arm 47 and a connecting rod 48. Tha is, the acceleration piston 42 is operatively coupled to the acceleration pedal through the throttle valve 2. When the throttle valve 2 is in the idling position, that is, when the throttle valve 2 is closing the air intake pipe 1, the acceleration piston 42 is in the lowermost position at which all of the return holes 34 are opened as shown in FIG. 4. On the other hand, when the throttle valve 2 is in the fully opened position, the acceleration piston 42 is in the upper position at which all of the over-driving holes 33 are closed while the return holes 34 are closed except the upper three ones in the case of the instant embodiment as shown in FIG. 4. Between the upper and lowermost positions as stated agove, the stroke or displacement of the acceleration piston 42 is in proportion to the opening degree of the throttle valve 2 or the intake air quantity as will be described in detail hereinafter. Since the opening degree, that is, the angle of the throttle valve 2 is not exactly in proportion to the intake air quantity, experiments must be made in order to measure the intake air quantity at various angles of the throttle valve 2. For instance, the intake air quantity is measured at several points on the circular curves PP' and QQ' traced by the free ends of the first and second arms 46 and 47. The linkage including the acceleration piston 42, its rod 43, the connecting rod 45, the first arm 46, the throttle valve 2, the second arm 47, the connecting rod 48 and the acceleration pedal may be so designed based upon the results of the above measurement that the stroke of the acceleration piston 42 may be exactly in proportion to the intake air quantity. The numerals such as 1/3, 2/3 and so on at the points on the arc QQ' in FIG. 5 show the intake air quantity in terms of the engine load. When the length of the connecting rod 45 is adjusted by suitable screw means, the compensation of the intake air quantity for the temperature variation may be attained.

The intake air pipe 1 is provided with a power air intake opening 49 which is normally closed by a rotatable sleeve ring 50 fitted over the intake air pipe 1 and provided with an opening equal in size to the air intake opening 49. The rotatable sleeve ring 50 is normally held under the force of a biasing spring (not shown) in such a position at which the ring 50 closes the air intake opening 49 under the normal engine operation. However, when the piston rod 43 extends upwardly beyond the point at which the throttle valve 2 is fully opened, the piston rod 43 causes the sleeve ring 50 to rotate against the biasing spring so that its opening may coincide with the power air intake opening 49, thereby opening the latter to suck extra air into the air intake pipe 1 as will be described in more detail hereinafter.

Figure 6:
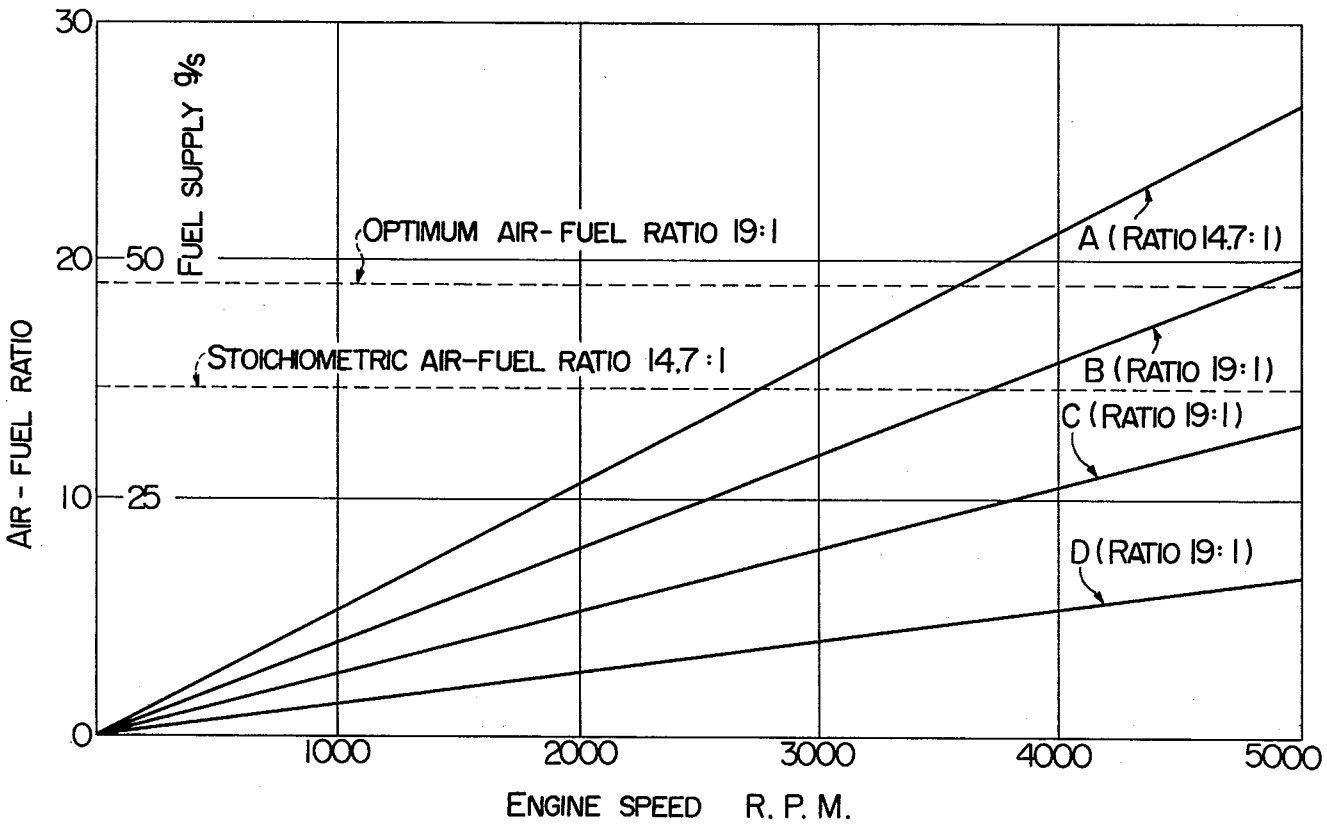
FIG. 6 is a graph used for the explanation of the mode of operation of the fuel supply system in accordance with the present invention.

FIG. 6 shows the relation between the air-fuel ratio and the speed of the engine incorporating the fuel supply system in accordance with the present invention. The straight line A indicates the quantity of fuel supplied from the fuel injection pump 7 to the shunt device 8 in proportion to the engine speed such that the air-fuel mixture with the stoichiometric ratio of 14.7 may be provided. The lines B, C and D indicate the injection quantity through the fuel injection nozzle 3 under the 3/3 (full load), 2/3 and 1/3 load, respectively, such that the air-fuel ratio of 19 may be attained. The shunt device 8 controls the fuel injection in such a way that the fuel injection quantity may be in proportion to the engine speed and that the fuel corresponding to the difference between the line A and the load line B, C or D may be returned to the governor pump 6 depending upon the load.

Next referring back to FIGS. 3, 4 and 5, the mode of operation of the fuel supply system with the above construction will be described hereinafter. As the engine is started, the diaphragm pump 5, the governor pump 6 and the fuel injection pump 7 are driven to supply the fuel to the fuel injection nozzle 3. Where the bypass line is connected between the fuel injection nozzle 3 and the recirculation line 10 as stated hereinbefore, the cock or valve is opened to supply the sufficient quantity of fuel to the fuel injection nozzle 3 to start the engine, and when the engine is started, the cock or valve is closed. As described above, the quantity of fuel supplied to the shunt device 8 from the fuel injection pump 7 is exactly in proportion with the engine speed, and the intake air quantity is also in proportion with the engine speed so that the ratio between the fuel quantity and the air quantity is constant independently of the engine speed. The fuel injection pump 7 is so designed as to have the discharge rate to provide the stoichiometric air-fuel ratio of 14.7.

Referring particularly to FIG. 4*a*, the fuel from the fuel pump 7 flows through the intake port 25 into the inlet chamber 20 in the shunt device 8. A part of the fuel flowing into the inlet chamber 20 further flows into the control chamber 27′ through the hole 31, and then flows through the supply port 30 to the fuel injection nozzle 3. The remaining fuel flows through the return holes 34 and the compensating hole 35 into the second cylinder bore 28 above the acceleration piston 42, and then is discharged through the outlet or discharge chamber 24, the discharge port 26 and the return line 9 to the governor pump 6.

The fuel injection pressure $\Delta P_f$, that is, the pressure in the control chamber 27′ in the first cylinder bore 27 below the control piston 36 is in proportion to the square of the fuel injection quantity. The fuel injection quantity must be in proportion to the engine speed so that the air-fuel mixture with the air-fuel ratio of 19 may be provided. Therefore the fuel injection pressure $\Delta P_f$ must be in proportion to the square of the engine speed and this reaction is shown by a conic section in FIG. 7. The control piston 36 is displaced in response to the fuel injection pressure $\Delta P_f$ which acts on the lower end of the control piston 36 so that the number of the metering holes 31 intercommunicating between the inlet chamber 20 and the control chamber 27′ changes depending upon the displacement of the control piston 36. When the number of the metering holes 31 opened is in proportion to the fuel injection quantity, the pressure difference $\Delta P_{f'}$ under which the fuel passes through the metering holes 31 is independent upon the fuel injection quantity so that the fuel injection quantity may be made in exact proportion to the quantity of fuel supplied from the fuel injection pump 7, that is, the engine speed.

Since the pressure $\Delta P_f$ acts upon the lower end of the control piston 36 which is biased downwardly under the force of the spring 37, the displacement of the control piston 36 is in proportion to the square of the fuel injection quantity. For this reason, the spacing between the adjacent metering holes 31 is reduced as the position of the holes 31 is lower. When it is difficult to form the metering holes 31 vertically in alignment with each other because the spacing therebetween is too small, the metering holes 31 may staggered or be arrayed in the zig-zag form.

Another method for making the number of opened metering holes 31 in proportion to the fuel injection quantity is to employ more than two springs for biasing the control piston 36 so that the number of springs acting upon the top end of the control piston 36 may be increased one by one as the control piston 36 rises. In this arrangement, since the spring pressure acting upon the piston 36 changes stepwise as the control piston 36 rises, irrespective of the pressure $\Delta P_f$ which is in proportion to the square of the fuel injection quantity, the displacement of the piston 36 is made approximately in proportion to the fuel injection quantity. Therefore the metering holes 31 may be spaced apart from each other by the same distance.

As the acceleration pedal is depressed or released the acceleration piston 42 is displaced to control the engine output. That is, in response to the opening degree of the throttle valve 2, that is, the intake air quantity, the number of the return holes 34 closed by the acceleration piston 42 changes so that the fuel to be recirculated or returned may be changed accordingly. Therefore the fuel flowing through the holes 31 from the inlet chamber 20 to the control chamber 27′ changes so that the control piston 36 is displaced to a new equilibrium position. In the new equilibrium position the fuel injection quantity is in proportion to the intake air quantity, which is controlled by the throttle valve 2, so that the air-fuel ratio may be maintained at the constant ratio of about 19 irrespective of the variation in engine output.

Figure 7:
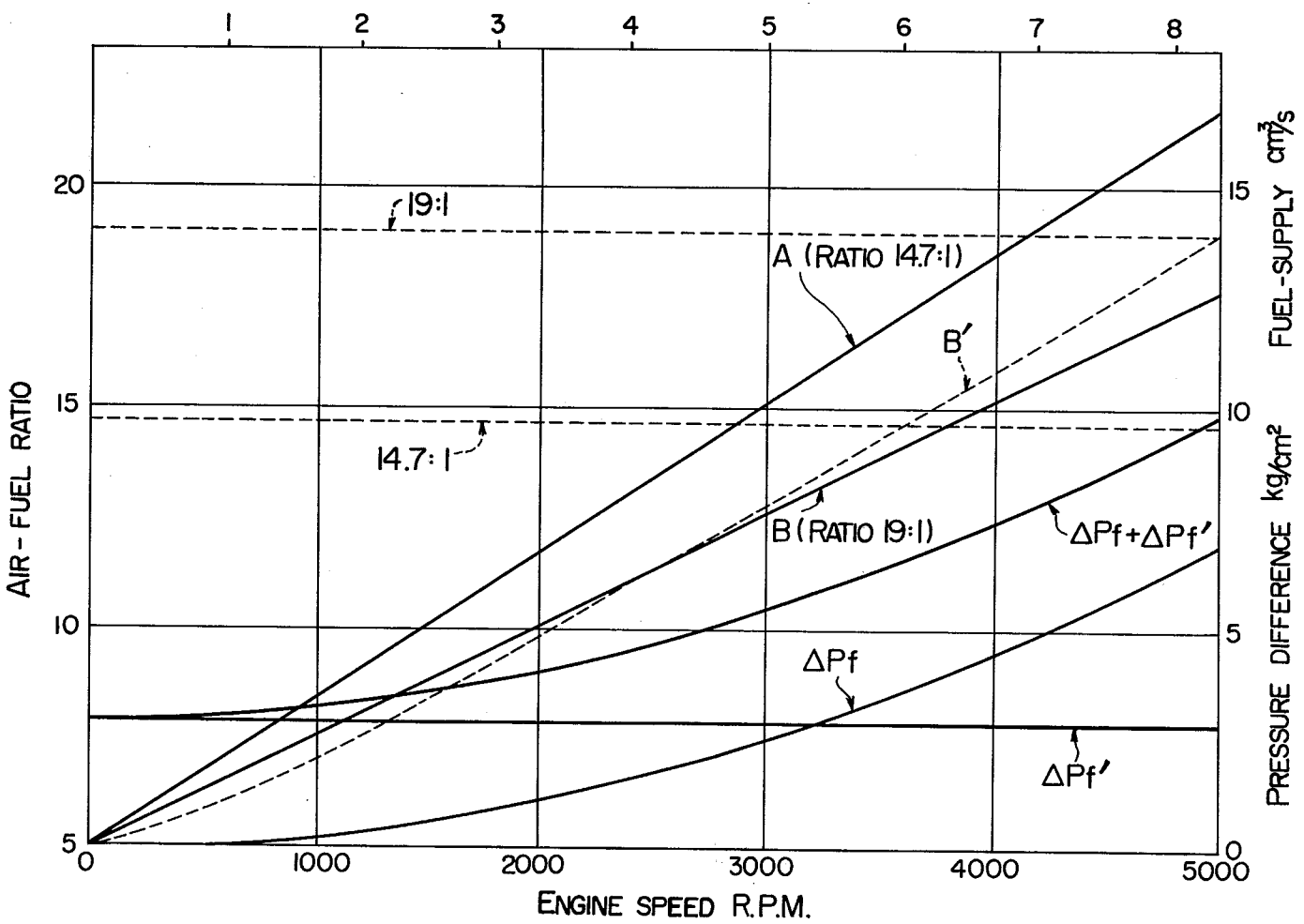
FIG. 7 is a graph used for the explanation of the deviation in fuel supply quantity due to the pressure generated in the fuel shunt device.

As described hereinbefore, the fuel injection quantity is indirectly controlled by controlling the quantity of fuel to be recirculated or returned so that the quantity of fuel to be recirculated must be also in exact proportion to the engine speed. The pressure of fuel in the inlet chamber 20 is equal to $\Delta P_f + \Delta P_{f'}$, the latter being the pressure drop across the metering holes 31. As described above the pressure $\Delta P_f$ is in proportion to the square of the fuel injection quantity which in turn is in porportion to the engine speed. Therefore the pressure $\Delta P_f$ is in proportion to the square of the engine speed. The pressure drop $\Delta P_{f'}$ is maintained constant as described above irrespectively of the fuel injection quantity so that $\Delta P_{f'}$ is constant as shown in FIG. 7 and is independent upon the engine speed. Therefore the $\Delta P_f + \Delta P_{f'}$ characteristic curve is equally spaced apart from the characteristic curve $\Delta P_f$ by the distance $\Delta P_{f'}$ as shown in FIG. 7. In case of the full load operation (3/3) indicated by the line B in FIG. 7, the quantity of fuel to be recirculated for providing the air-fuel mixture with the air-fuel ratio of 19 corresponds to the difference between the lines A and B and must be in proportion to the engine speed. The quantity of fuel to be recirculated through the return holes 34 is in proportion to the root of the pressure $\Delta P_f + \Delta P_{f'}$ in the inlet chamber 20, not in proportion to the speed of the engine speed so that the quantity of fuel injected throught the nozzle 3 is indicated by the curve B′ shown in FIG. 7. As a result, the fuel injection quantity becomes too much at high speeds while it is insufficient at low speeds. That is, the air-fuel ratio is richer than 19 at high speeds while it is leaner than 19 at low speeds. However, the deviation of the air-fuel ratio from 19 is not so great that the exhaust gas cleaning operation will not be so seriously affected, but in order to attain the optimum results the compensating hole 35 is provided as will be described hereinafter.

Figure 8:
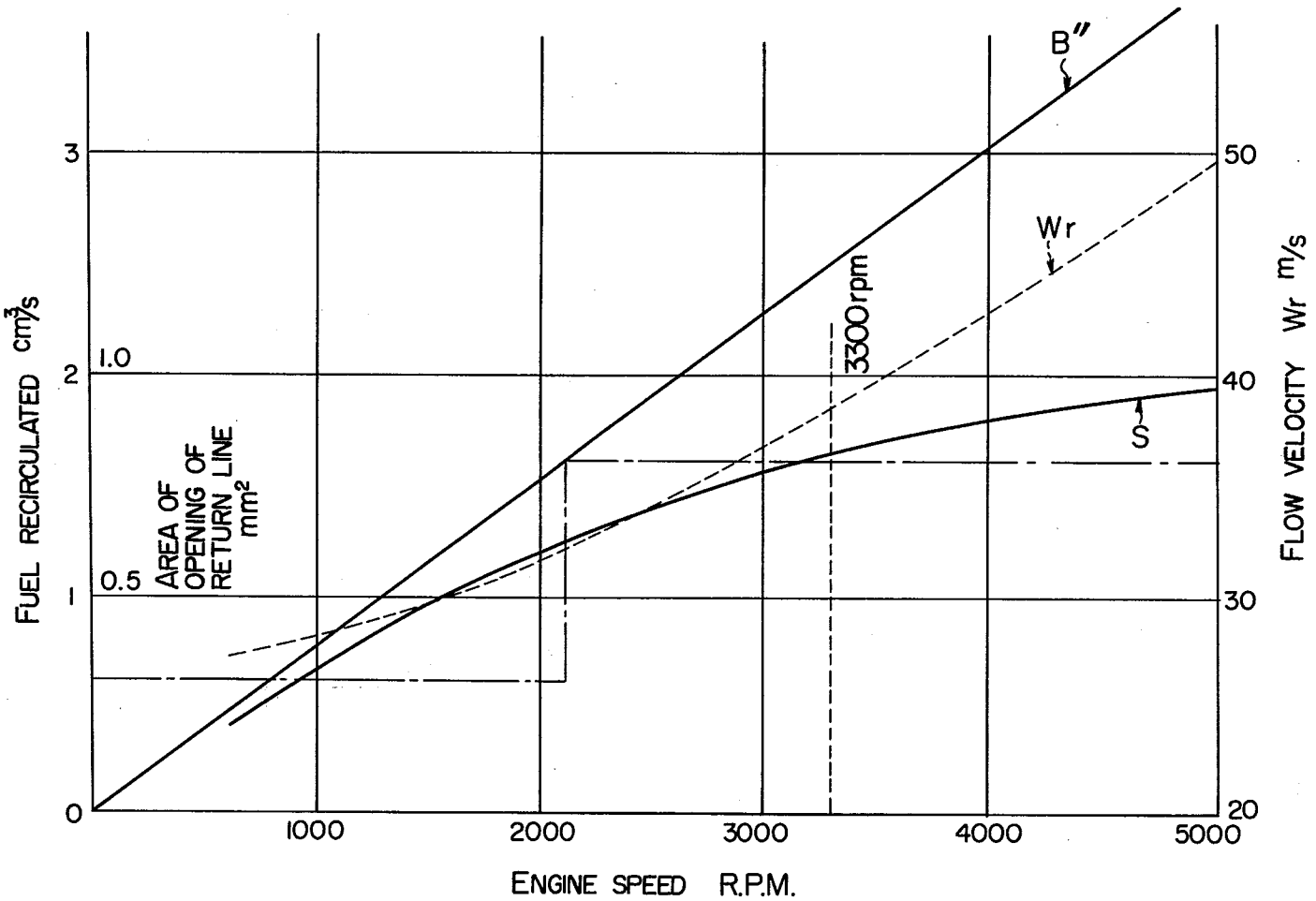
FIG. 8 is a graph used for the explanation of the method for compensating the deviation in the fuel supply quantity in the fuel system in accordance with the present invention.

Referring to FIG. 8, the line B″ indicates the quantity of fuel to be recirculated in order that the fuel injection may be effected as indicated by the line B in FIG. 7. The quantity of fuel to be recirculated must be in proportion to the engine speed. When the number of the return holes opened is maintained constant, the flow velocity of the fuel flowing through the return holes is in proportion to the root of the pressure $\Delta P_f + \Delta P_{f'}$ in the inlet chamber 20 which is not in proportion to the engine speed as described elsewhere. Thus the relation between the flow velocity of the fuel flowing through the return holes and the engine speed is indicated by the curve Wr in FIG. 8. Therefore, the total sectional area or number of the return holes opened must be increased gradually as indicated by the curve S as the engine speed is increased, in order that the quantity of fuel to be recirculated may be controlled as indicated by the straight line B″. Therefore, the fuel shunt device shown in FIG. 4 is provided with the first compensating hole 35 which is normally opened independently of the engin speed and the second compensating hole 32 which is opened only when the engine speed exceeds a predetermined level. Therefore in the low speed region centered around 1000 r.p.m. the compensation is made by utilizing the first compensating hole while in the high speed region centered around the engine speed of 3,300 r.p.m. both the first and second compensating holes 35 and 32 are used so that the curve S may be approximated by the line segments indicated by the one-dot chain lines as shown in FIG. 8.

The mode of compensation will be described in more detail with reference to FIG. 4. As described above, the acceleration piston 42 is displaced upward or downward to increase or reduce the number of the return holes 34 opened so as to adjust the engine output. Under the full load condition, the acceleration piston 42 is located at a position very close to the position at which the acceleration piston 42 opens the overdriving holes 33, and the first compensating hole 35 and the three upper return holes 34 are opened. When the load is reduced, the acceleration piston is lowered. Therefore the first compensating hole 35 is normally opened under the normal operating condition. When the engine speed is increased so that the pressure in the control chamber 27' increases to raise the control piston 36, the annular groove 40 of the control piston 36 coincides with the second compensating hole 32. As a result, another compensation path is formed from the inlet chamber 20 through the second compensating hole 32, the annular groove 40 and the passage 41 to the discharge chamber 24, whereby the want of the quantity of fuel to be recirculated at high speeds may be automatically supplemented.

Under the normal operating condition, only a part of the fuel discharged from the fuel injection pump 7 is injected through the fuel injection nozzle 3, but the whole quantity of fuel discharged from the pump 7 may be supplied to the fuel injection nozzle 3 when the extra power is required. That is, when the acceleration pedal is kicked down, the acceleration piston 42 rises beyond the full load position, opening the over-driving holes 33 one by one from the lowest one while closing the return holes 34 one by one. As a result, the fuel flows through the over-driving hole or holes 33 into the space below the acceleration piston 42, and then flows through the communication hole 29 to join the fuel flow flowing from the control chamber 27'. When the acceleration pedal is completely depressed to the full stroke, all of the over-driving holes 33 are opened while the compensating hole 35 and all of the return holes 34 are closed. When the engine speed reaches the maximum under these conditions, the control piston 36 reaches the uppermost position so that the annular groove 40 is located above second compensating hole 32. Therefore the quantity of fuel to be circulated becomes zero, and the whole quantity of fuel discharged from the fuel injection pump 7 is supplied to the fuel injection nozzle 3 to provide the air-fuel mixture with the stoichiometric air-fuel ratio of 14.7.

In this case, the throttle valve 2 rotates beyond the fully opened position and is positioned at an angle relative to the direction of the air flow in the air intake pipe 1 so that the intake air quantity decreases. However, as shown in FIG. 5, when the acceleration piston 42 is raised beyond the full-load position to the power position, the piston rod 43 causes the sleeve ring 50 to rotate to open the power air intake opening 49 so that the extra air may be sucked into the air intake pipe 1. Thus even in case of the power accelerating or boosting operation, the air-fuel ratio may be maintained at the optimum ratio.

To apply the engine braking, the driver releases the acceleration pedal to close the throttle valve 2 as with the case of the engine with the conventional carburetor. In the conventional engine, the suction of fuel is increased in excess of the required quantity due to the strong negative pressure, resulting in the waste of the fuel. However according to the present invention both the control and acceleration pistons 36 and 42 are lowered to the lowermost position so that the fuel is permitted to flow into the control chamber 27' and hence to the fuel injection nozzle 3 only through one metering hole 31 from the inlet chamber 20. Thus the fuel injection quantity may be maintained at the minimum to continue the engine operation.

As described above, the internal combustion engine incorporating the fuel supply system in accordance with the present invention may be operated substantially in the same manner with the engines with the conventional carburetor, and the air-fuel ratio may be automatically maintained at the optimum ratio of, for instance, 19 independently of the engine speed and engine operating conditions so that the pollutant emission may be minimized.

It is to be understood that the present invention is not limited to the preferred embodiment described above and that various modifications may be effected within the spirit of the present invention. For instance, instead of the valve structure comprising a piston to open and close a plurality of small holes axially aligned the shunt device may have any suitable valve means to control the fuel quantity to be injected or recirculated.

What is claimed is:

1. In an internal combustion engine of the type in which the air is supplied substantially in proportion to the engine speed and the opening degree of a throttle valve and the fuel to be mixed with said air is injected through a fuel injection nozzle, a fuel supply system comprising a. pump means which discharges the fuel in proportion to the engine speed, said pump means including:

a gear type governor pump driven at a speed in proportion to the speed of the engine, a gear type fuel injection pump the suction port of which is hydraulically connected to the discharge port of said governor pump, which is driven at a speed in proportion to the speed of said engine, and which has the discharge rate half as much as that of said governor pump, and a recirculation line hydraulically interconnecting between the suction and discharge ports of said governor pump and having therein disposed a governor nozzle the diameter of the nozzle hole of which is equal to that of said fuel injection nozzle; and b. a fuel shunt device for supplying a part of the fuel supplied from said pump means to said fuel injection nozzle while recirculating the remaining fuel to said pump means, said fuel shunt device having first valve means for automatically controlling the area of the opening of a passage hydraulically connecting said fuel shunt device to said fuel injection nozzle in proportion to the discharge rate of said pump means, and second valve means for automatically controlling the area of the opening of a return line hydraulically connecting said fuel shunt device to said pump means in inverse proportion to the opening degree of said throttle valve, whereby the air-fuel mixture with a substantially constant air-fuel ratio independently of the speed and load of the engine may be charged into said engine.

2. In an internal combustion engine of the type in which the air is supplied substantially in proportion to the engine speed and the opening degree of a throttle valve and the fuel to be mixed with said air is injected through a fuel injection nozzle, a fuel supply system comprising a. pump means which discharges the fuel in proportion to the engine speed, and b. a fuel shunt device for supplying a part of the fuel supplied from said pump means to said fuel injection nozzle while recirculating the remaining fuel to said pump means, said fuel shunt device having means for automatically controlling the area of the opening of a passage hydraulically connecting said fuel shunt device to said fuel injection nozzle in proportion to the discharge rate of said pump means, and means for automatically controlling the area of the opening of a return line hydraulically connecting said fuel shunt device to said pump means in inverse proportion to the opening degree of said throttle valve, said controlling means comprising:

a cylinder block having a first and a second cylinder bores formed through said cylinder block in the axial direction thereof, a casing fitted over said cylinder block coaxially thereof so as to define with said cylinder block an inlet chamber in communication with the discharge side of said pump means and to define with the top of said cylinder block a discharge chamber in communication with the suction side of said pump means, a control piston slidably fitted into said first cylinder bore, an acceleration piston slidably fitted into said second cylinder bore, a control chamber defined within said first cylinder bore below the lower end of said control piston and normally hydraulically communicated with said fuel injection nozzle, the space in said second cylinder bore above the top end of said acceleration piston being normally hydraulically communicated with said discharge chamber, a plurality of metering holes for intercommunicating hydraulically between said control chamber and said inlet chamber, said metering holes having the same diameter and being in the axial direction of said first cylinder bore spaced apart from each other in a predetermined relation, a plurality of return holes for intercommunicating hydraulically between said space in said second cylinder bore above the top end of said acceleration piston and said inlet chamber, said return holes having the same diameter and being in the axial direction of the second cylinder bore equidistantly spaced apart from each other, said control piston being normally biased downward by spring means and being displaced in response to the pressure in said control chamber, thereby opening or closing said metering holes, the number of said metering holes opened being controlled in accordance with the displacement of said control piston, and said acceleration piston being operatively coupled to said throttle valve in such a way that the number of said return holes opened by the stroke of said acceleration piston may be in inverse porportion to the opening degree of said throttle valve, whereby the air-fuel mixture with a substantially constant air-fuel ratio independently of the speed and load of the engine may be charged into said engine.

3. A fuel supply system as set forth in claim 2 wherein the spacing between the adjacent metering holes between said control chamber and said inlet chamber is reduced as the position of said metering holes becomes lower, and the force of said spring means for biasing said control piston changes linearly, in response to the displacement of said control piston.

4. A fuel supply system as set forth in claim 2 wherein the space in said first cylinder bore above the top end of said control piston is normally communicated with said discharge chamber and is hydraulicaly communicated with said inlet chamber through a compensating hole which is in the axial direction of said first cylinder bore spaced apart from the uppermost metering hole by a suitable distance, and said control piston has an annular groove formed around the side surface thereof and hydraulically communicated with said space in said first cylinder above the top end of said control piston through a passage formed through said control piston, whereby when said control piston is raised by a predetermined stroke against said biase spring means as the pressure in said control chamber increases to a predetermined level, said annular groove coincides with said compensating hole to hydraulically intercommunicate between said inlet and discharge chambers.

5. A fuel supply system as set forth in claim 2 wherein the space in said second cylinder bore below the lower end of said acceleration piston is normally hydraulically communicated with said control chamber in said first cylinder bore and further hydraulically communicated with said inlet chamber through a plurality of over-driving holes which are formed through said cylinder block said over-driving holes being in the axial direction of said second cylinder bore equidistantly spaced apart from each other, whereby when said acceleration piston is displaced beyond the full load position at which a predetermined number of said return holes are closed, said over-driving holes are opened one by one depending upon the stroke of said acceleration piston.

* * * * *